US011180982B2

(12) United States Patent
Arshad et al.

(10) Patent No.: US 11,180,982 B2
(45) Date of Patent: Nov. 23, 2021

(54) SYSTEMS AND METHODS TO SAFEGUARD WELL INTEGRITY FROM HYDRAULIC FRACTURING

(71) Applicant: Saudi Arabian Oil Company, Dhahran (SA)

(72) Inventors: Waheed Syed Arshad, Mississauga (CA); Khaqan Khan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/853,902

(22) Filed: Apr. 21, 2020

(65) Prior Publication Data

US 2021/0324728 A1 Oct. 21, 2021

(51) Int. Cl.
*E21B 47/005* (2012.01)
*E21B 49/00* (2006.01)
(Continued)

(52) U.S. Cl.
CPC ..... *E21B 47/005* (2020.05); *E21B 33/14* (2013.01); *E21B 43/11* (2013.01); *E21B 43/267* (2013.01); *E21B 43/27* (2020.05); *E21B 49/00* (2013.01)

(58) Field of Classification Search
CPC ..... E21B 47/005; E21B 43/27; E21B 33/14; E21B 43/267; E21B 49/00
See application file for complete search history.

(56) References Cited

U.S. PATENT DOCUMENTS 6,296,057 B2 10/2001 Thiercelin
7,653,563 B2 1/2010 Veeningen et al.
(Continued)

FOREIGN PATENT DOCUMENTS

CN 105760564 B 7/2016
WO 2018009216 A1 1/2018
(Continued)

OTHER PUBLICATIONS

AECOM Auslralia Pty Ltd; "APLNG Project Hydraulic Fracturing Assessment" Mar. 6, 2017; pp. 1-68.
Brechan, Bjom et al.; "Well Integrity Risk Assessment—Software Model for the Future" OTC-28481-MS, Offshore Technology Conference Asia, Malaysia, Mar. 20-23, 2018; pp. 1-18.
(Continued)

*Primary Examiner* — Silvana C Runyan
(74) *Attorney, Agent, or Firm* — Bracewell LLP; Constance G. Rhebergen; Vivek P. Shankam

(57) ABSTRACT

Methods and systems for determining risk of pipe deformation in a hydraulic fracturing operation include receiving a plurality of parameters pertaining to the well operation from a plurality of wells, developing a relationship between the plurality of parameters and a risk of pipe deformation, receiving the plurality of parameters pertaining to the well operation from a predetermined well, and determining the risk of pipe deformation in the predetermined well based on the plurality of parameters. The method further includes taking corrective action to prevent the pipe from deformation, such as improving the cementing conditions of the casing, performing cement bond evaluation, choosing safe locations for hydraulic fracturing or skipping zones of high risk or managing around pipe deformation by deploying flow-through bridge plugs, or dissolvable bridge plugs, or any other type of isolation method that does not require well intervention to remove the barrier or altogether re-drill a new well.

7 Claims, 13 Drawing Sheets

(51) Int. Cl.

| | |
|---|---|
| ***E21B 43/11*** | (2006.01) |
| ***E21B 43/267*** | (2006.01) |
| ***E21B 43/27*** | (2006.01) |
| ***E21B 33/14*** | (2006.01) |

(56) References Cited

U.S. PATENT DOCUMENTS

| | | | | |
|---|---|---|---|---|
| 7,739,089 | B2 | 6/2010 | Gurpinar et al. | |
| 2009/0292516 | A1 | 11/2009 | Searles et al. | |
| 2014/0191904 | A1* | 7/2014 | Illerhaus | E21B 17/006 342/464 |
| 2016/0102528 | A1 | 4/2016 | Wise et al. | |
| 2016/0153239 | A1* | 6/2016 | Randall | E21B 41/0078 175/4.57 |
| 2018/0010429 | A1 | 1/2018 | Willberg et al. | |
| 2018/0113966 | A1 | 4/2018 | Reese et al. | |
| 2018/0293789 | A1 | 10/2018 | Shen et al. | |
| 2020/0072995 | A1* | 3/2020 | Milne | G01D 5/35316 |
| 2020/0325759 | A1* | 10/2020 | Sharma | E21B 49/006 |

FOREIGN PATENT DOCUMENTS

| | | | |
|---|---|---|---|
| WO | 2019051435 | A1 | 3/2019 |
| WO | 2019140287 | A1 | 7/2019 |

OTHER PUBLICATIONS

Fretwell, Ben et al.; "Evidence—Review of assessment procedures for shale gas well casing installation" Environment Agency, Oct. 2012; pp. 1-98.

Li, Jun et al.; "New Analytical Method to Evaluate Casing Integrity during Hydraulic Fracturing of Shale Gas Wells" Hindawi Shock and Vibration, vol. 2019, Article ID 4253241; pp. 1-19.

International Search Report and Written Opinion for International Application No. PCT/US2021/028083, dated Jul. 23, 2021; pp. 1-17.

Mohammed, Auwalu I. et al.; "Casing structural integrity and failure modes in a range of well types—A review" Journal of Natural Gas Science and Engineering 68 (2019); pp. 1-25.

Noshi, Christine et al.; "Data Mining Approaches for Casing Failure Prediction and Prevention" IPTC-19311-MS, International Petroleum Technology Conference, Beijing, China, Mar. 26-28, 2019; pp. 1-23.

* cited by examiner

Azimuth:243, Surgi-squeeze TOE
P&P heel, 13660 psi
Drilled 2 plugs with 3.56" mill.
Didn't drill other plugs. Fish (gun) in hole. Well on prod, 15.1ppf pipe Milled all plugs
18150psi/13070psi
Azimuth:340, 15 kpsi Milled all plugs
19960psi
Azimuth:3, 15 kpsi Milled all plugs
19833psi/14389psi
Azimuth:180, 15 kpsi No liner deformation Could not mill (3.125" mill)
19212psi/14037psi
Azimuth:177, 15 kpsi Could not mill (3.125" mill)
21039psi/14579psi
Azimuth:150, kpsi Liner deformation reported Could not mill top 5 plugs,
2.75" mill
20579psi/14426psi
Azimuth:340, kpsi

500

SYSTEMS AND METHODS TO SAFEGUARD WELL INTEGRITY FROM HYDRAULIC FRACTURING

TECHNICAL FIELD

Example embodiments relate to systems and methods for safeguarding well integrity resulting from hydraulic fracturing treatment to ensure hydrocarbon production from the well.

BACKGROUND

Hydraulic fracturing or "fracking" is a commonly utilized technique in oil and gas wells for accessing hydrocarbons from formations that are tight in nature. These formations have low permeability which do not allow fluids to flow easily. Hydraulic fracturing creates fractures in these tight rocks thus providing a conduit for fluids to flow much more easily. In some cases wells completed with cemented pipe deform during fracturing operation or immediately afterwards. Pipe deformation affects the wellbore integrity, resulting in a loss of tubing drift along the wellbore and in some cases loss of zonal isolation, which affects well production and deliverability.

With significant increase in multi-stage hydraulic fracturing due to development of hydrocarbons from tight rock and shale development the occurrences of casing failures have also become noticeable, raising wellbore integrity concerns amongst operators worldwide. The consequences of casing failures can be varied but, in many cases, it affects the well production, wellbore accessibility and in some rare instances present a situation of well control and its associated risks. Managing well integrity is essential to economically develop oil and gas resources while preserving the environment and assuring safety to personnel.

The multi-stage fracturing being considered in this disclosure relates to "perf and plug" type of fracturing for cased holes and cemented completions. In this process the operator perforates a zone of interest (hydrocarbon pay zone) towards the deepest part of a horizontal well, hydraulically fractures the zone, isolates the zone with a bridge plug and then perforates the next zone uphole followed by fracturing and isolating it. This cycle is repeated based on the number of zones that need to be stimulated. At the end of the process the bridge plugs that are set for zonal isolation between the fractured zones are drilled out with a drill-bit (or "milled out" with a mill-bit, both terms used interchangeably in this document to convey the meaning of removing the bridge plug or any other type of isolation medium set between zones) and all the zones are opened up to allow the well to flow for production. The type of casing failures being addressed in this disclosure are restrictions observed in the internal diameter of the pipe after the hydraulic fracturing treatment when going in with a drill-bit to drill the bridge plugs. The reasons for tubular damage are not limited to one specific reason rather it varies greatly across the industry. Investigators have identified several different factors that come into play.

For example, even though higher than normal internal burst loads are considered in the production casing design for high-rate, multi-stage hydraulic fracturing of unconventional wells, casing failure can result due to inadequate cement bonding around the casing when exposed to high-fracturing collapse loads. Another aspect of multi-stage hydraulic fracturing of tight rock and unconventional wells is that repetitive pressure and temperature cycles can create loads that exceed the failure envelope of the production casing. These additional cyclic loads are normally not experienced in conventional, single stage fracturing jobs.

Conventional casing collapse design is based upon uniform external pressure loading on the casing. Conventional design considers pore pressure and does not account for the effects on casing stresses from the external cement sheath and the stress imposed by the surrounding formation. In addition, the conventional design does not predict the collapse load of non-uniform loaded casing that arises from imperfect cement jobs that lead to formation of voids within in the cement sheath nor the voids that can develop in the formation during the drilling process.

There are also a lot of reports of formation induced damage of wells world-wide. Despite extensive literature on the subject, formation induced damage is not a standardized part of well design. One reason may be that the associated fundamental mechanism is not yet fully understood, which makes it difficult to implement in design rules.

SUMMARY

Accordingly, one example embodiment of the present disclosure is a method and system for evaluating a wellbore condition through caliper logs, wellbore trajectory, and cement bond logs in conjunction with the standard petrophysical logs to predict casing failure that can result from hydraulic fracturing. This disclosure provides new methods to safeguard well integrity during and after hydraulic fracturing treatment to ensure hydrocarbon production from well.

One example embodiment is a method for deriving a relationship between borehole condition (primarily hole size), well deviation, well azimuth, dogleg severity, pipe centralization, the type of hydraulic fracturing treatment performed (e.g. proppant fracking or acid fracking), and the risk of pipe deformation. By understanding the primary factors that affect well integrity the likelihood of casing failure can be predicted and avoided ahead of time. The term "casing failure" as used herein is defined as a change or restriction in the internal diameter of the pipe from its initial completion state before hydraulic fracturing that impedes the running in hole of tools that would have done so freely otherwise.

After reviewing data from several wells, a relationship between borehole condition (primarily hole size), well deviation, dogleg severity, pipe centralization, the type of hydraulic treatment performed (e.g. proppant fracking or acid fracking), and the risk of pipe deformation has been developed. The relationship can be used to avoid the risk of pipe deformation during hydraulic fracturing operations in cased and cemented wells. More specifically, the method performs a set of evaluations on the drilled wellbore to explain the occurrences of pipe deformation in cemented wellbore during hydraulic fracturing operations. By being able to predict and avoid perforating zones of potential pipe deformation on a well could save fracturing costs across high risk areas, maintain well integrity and safety of operations, as well as avoid jeopardizing production from a multi-million dollar well completion. The potential cost saving could be as high as USD 12-15 million or more per well depending on the geographical location of the well and its related economics.

One example embodiment is a method for determining risk of pipe deformation in a hydraulic fracturing operation. The method includes receiving a plurality of parameters pertaining to the well operation from a plurality of wells, developing a relationship between the plurality of parameters and a risk of pipe deformation, receiving the plurality of parameters pertaining to the well operation from a predetermined well, and determining the risk of pipe deformation in the predetermined well based on the plurality of parameters. The method can further include taking corrective actions to prevent the pipe from deformation, such as improving the cementing conditions of the casing, performing cement bond evaluation, choosing safe locations for hydraulic fracturing or skipping zones of high risk or managing around pipe deformation by deploying flow-through bridge plugs, or dissolvable bridge plugs, or any other type of isolation method that does not require well intervention to remove the barrier or altogether re-drill a new, replacement well. The plurality of parameters include at least two of borehole condition, primarily hole size, well deviation, dogleg severity, pipe centralization, cement bond log, presence of natural fractures, and type of hydraulic treatment performed. In one embodiment, the plurality of parameters are weighted in an internal risk matrix.

Another example embodiment is a system for determining risk of pipe deformation in a hydraulic fracturing operation. The system includes a processor for receiving a plurality of parameters pertaining to the well operation from a plurality of wells, developing a relationship between the plurality of parameters and a risk of pipe deformation, receiving the plurality of parameters pertaining to the well operation from a predetermined well, and determining the risk of pipe deformation in the predetermined well based on the plurality of parameters. The method can further include taking corrective action to prevent the pipe from deformation, such as improving the cementing conditions of the casing, performing cement bond evaluation, choosing safe locations for hydraulic fracturing or skipping zones of high risk or managing around pipe deformation by deploying flow-through bridge plugs, or dissolvable bridge plugs, or any other type of isolation method that does not require well intervention to remove the barrier or altogether re-drill a new, replacement well. The plurality of parameters include at least two of borehole condition, primarily hole size, well deviation, dogleg severity, the influence of formation structure and layering on well trajectory, intrinsic anisotropy analysis on bedding planes for possible bedding plane movement, casing centralization, cement bond log, presence of natural fractures, and type of hydraulic treatment performed. In one embodiment, the plurality of parameters are weighted in an internal risk matrix.

BRIEF DESCRIPTION OF THE DRAWINGS

So that the manner in which the features, advantages and objects of the invention, as well as others which may become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only example embodiments of the invention and is therefore not to be considered limiting of its scope as the invention may admit to other equally effective embodiments.

DETAILED DESCRIPTION

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

Figure 1:
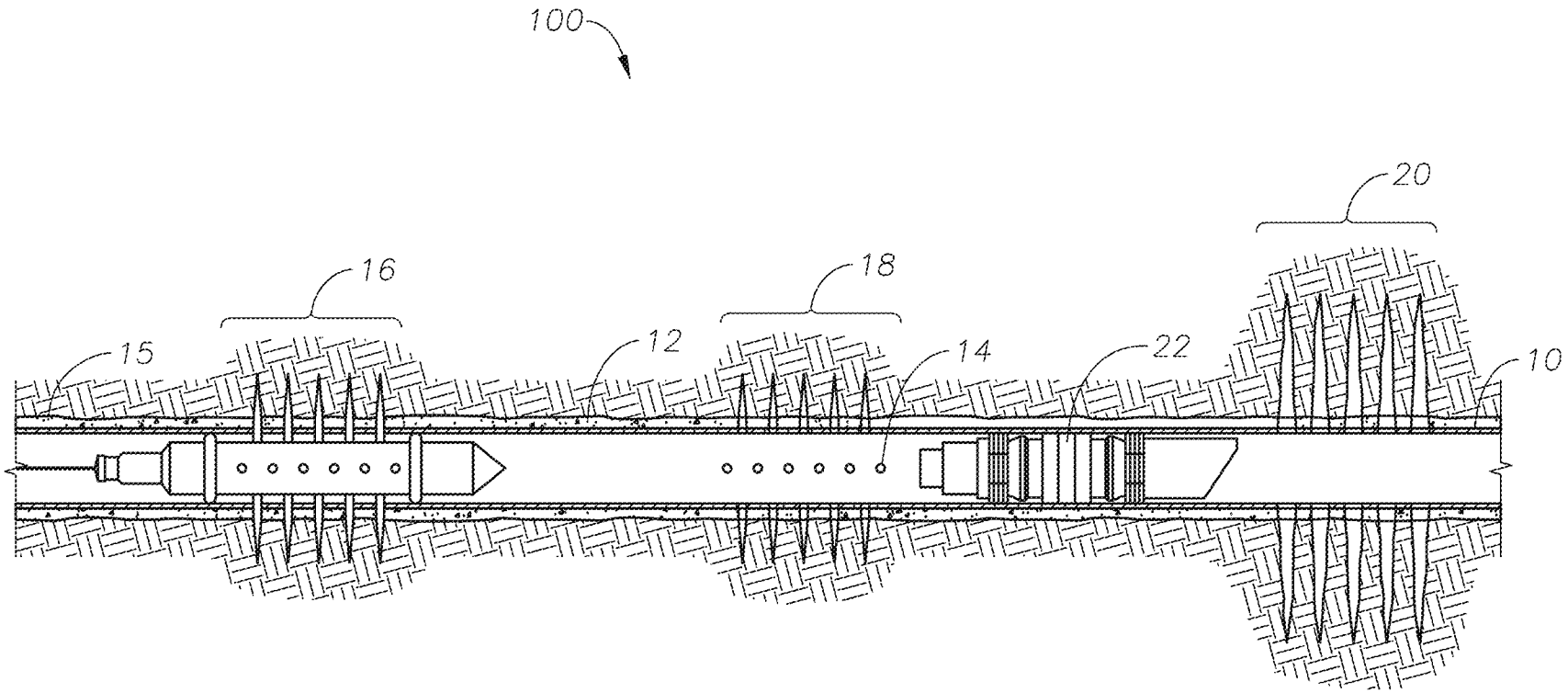
FIG. 1 illustrates a "perf and plug" hydraulic fracturing operation in a horizontal well, according to one or more example embodiments of the disclosure.

FIG. 1 is a representation of the "perf and plug" hydraulic fracturing operation 100 in a horizontal well. After drilling a wellbore 15 in the formation of interest, a steel pipe or casing 10 of required grade and properties is run in the wellbore 15. The annular space 12 between the formation and the pipe is filled by pumping cement, which is allowed to harden over several weeks before hydraulic fracturing is performed. It should be noted that due to prevailing in-situ stress conditions and the wellbore geometry with respect to in-situ-stress state, the borehole diameter may not be uniform. For example, a well drilled in the direction of minimum horizontal stress direction in a strike slip stress regime can experience high stress concentration at the top and bottom of the wellbore resulting in failure of wellbore wall, which makes the wellbore wall ovalized. Ovalized wellbores can lead to several issues such as well drifting, high doglegs severity, uneven formation loading on pipe, casing eccentricity, channeling through the cement sheath, and poor cement bonding. Under the influence of these artifacts, non-uniform loading can act on casing pipe during high pressure, hydraulic fracturing operations, which can cause the pipe to deform in the direction of the void (ovality).

In a perf and plug operation, the pipe 10 is hydraulically fractured at several points 14, and in poor well conditions pipe deformation can also occur at these points. The perf and plug operation 100 is a multi-stage fracturing technique by which several zones 16, 18, 20 get individually stimulated (via hydraulic fracturing) in sequence. FIG. 1 shows that zone 20, which is the first zone in the lateral hole section, has been hydraulically fractured and then isolated with a bridge plug 22 so that the next zone 18 can be individually stimulated. FIG. 1 also shows zone 18 which is in the process of being perforated and then will be fractured and isolated with another bridge plug 22 before continuing on to zone 16 and onwards. After all zones of interest are fractured, the bridge plugs 22 are drilled out with a bit and the well is put to production.

Figure 2:
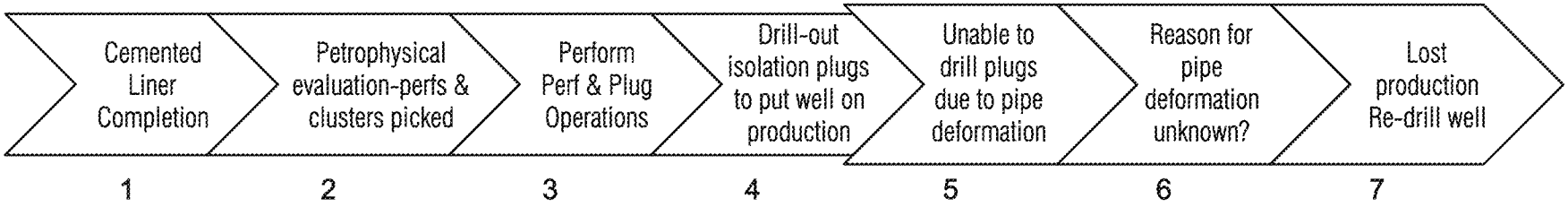
FIG. 2 illustrates example steps in a method for determining risk of pipe deformation in a hydraulic fracturing operation, according to one or more example embodiments of the disclosure.

FIG. 2 is a representation of a sequence of activities 1-7 carried out in the process of completing a well, performing hydraulic fracturing, and putting it to production. FIG. 2 also shows stages 5-7 where problems are encountered during operation. Steps 1 and 2 are stages where the wellbore has been cased-off and cemented, and the best zones that need to be fractured are chosen based on petrophysical evaluation from well logs. Step 3 is the perf and plug operation (described in FIG. 1) and Step 4 is where the plugs are drilled out for well production. Step 5 is a problem stage where the plugs are not able to be drilled out due to the internal pipe diameter restriction or the drill-bit cannot be run in the hole because of a deformed casing. Steps 6-7 are the consequences of the problem seen in Step 5. For example, in Step 6 the reason for pipe deformation may be unknown and in Step 7 the production is lost and there is a need to re-drill a replacement well.

Figure 3:
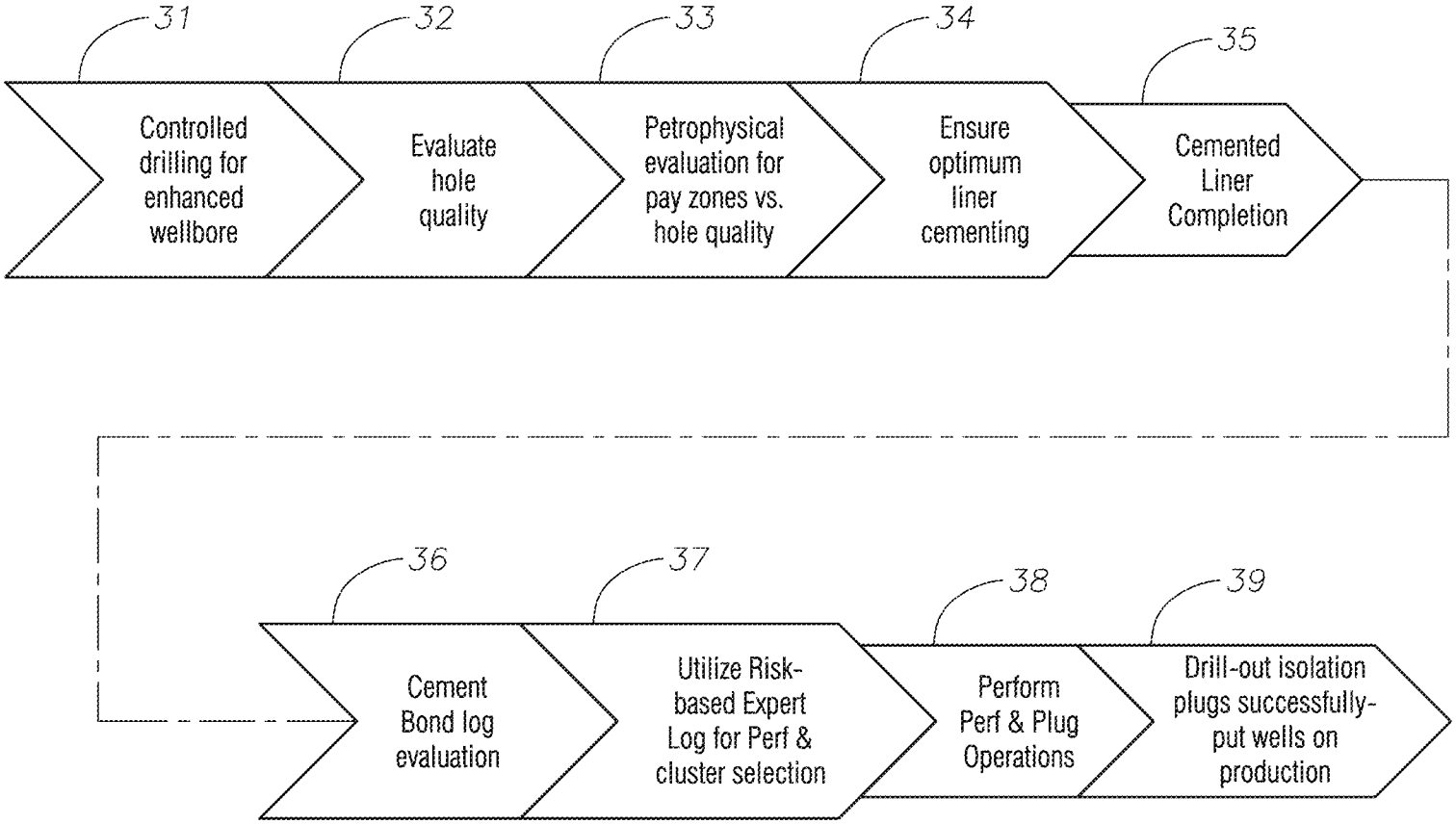
FIG. 3 illustrates example steps in a method for determining risk of pipe deformation in a hydraulic fracturing operation, according to one or more example embodiments of the disclosure.
Figure 4A:
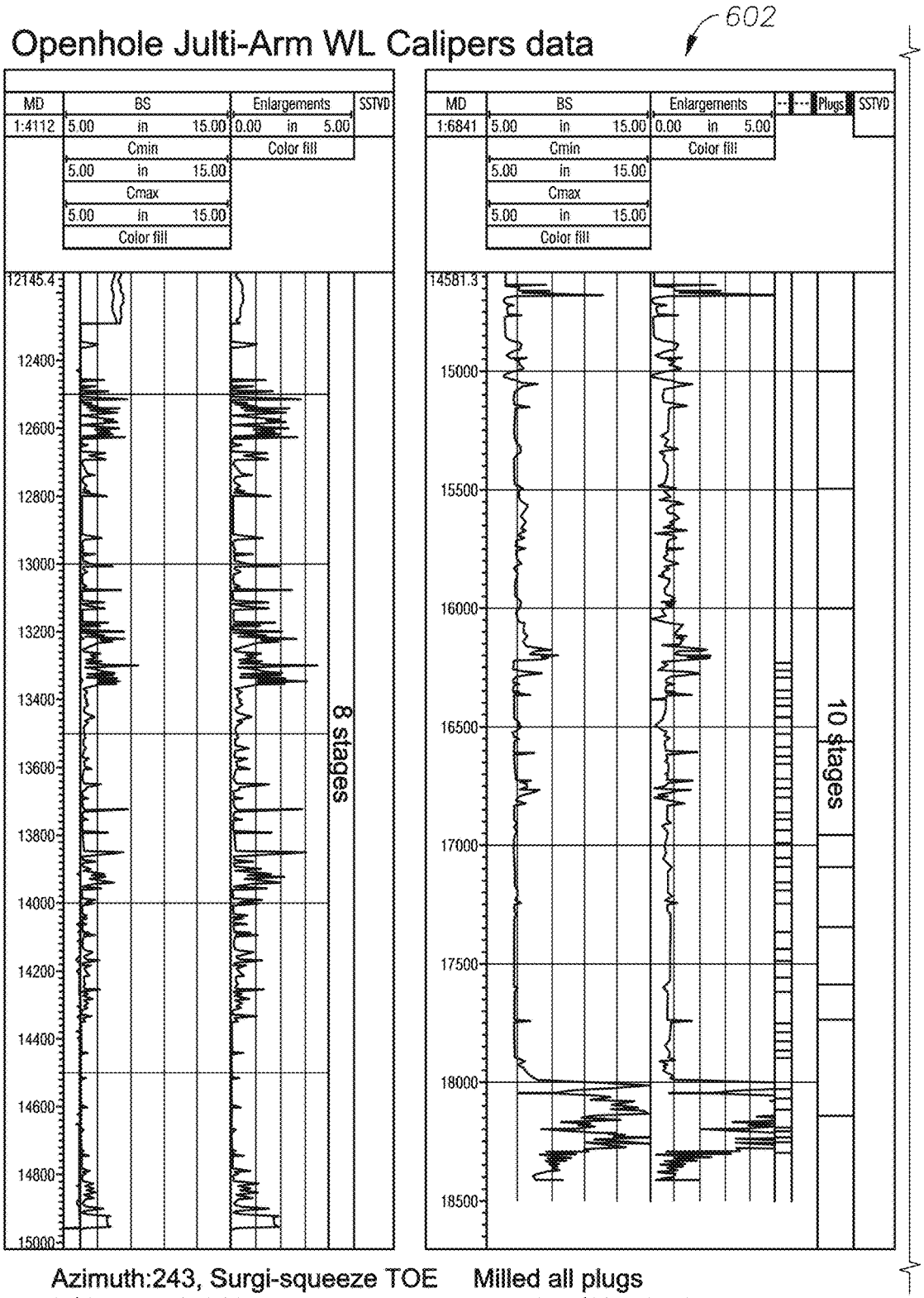
FIGS. 4A-4D illustrate example steps in a method for determining risk of pipe deformation in a hydraulic fracturing operation, according to one or more example embodiments of the disclosure.
Figure 4B:
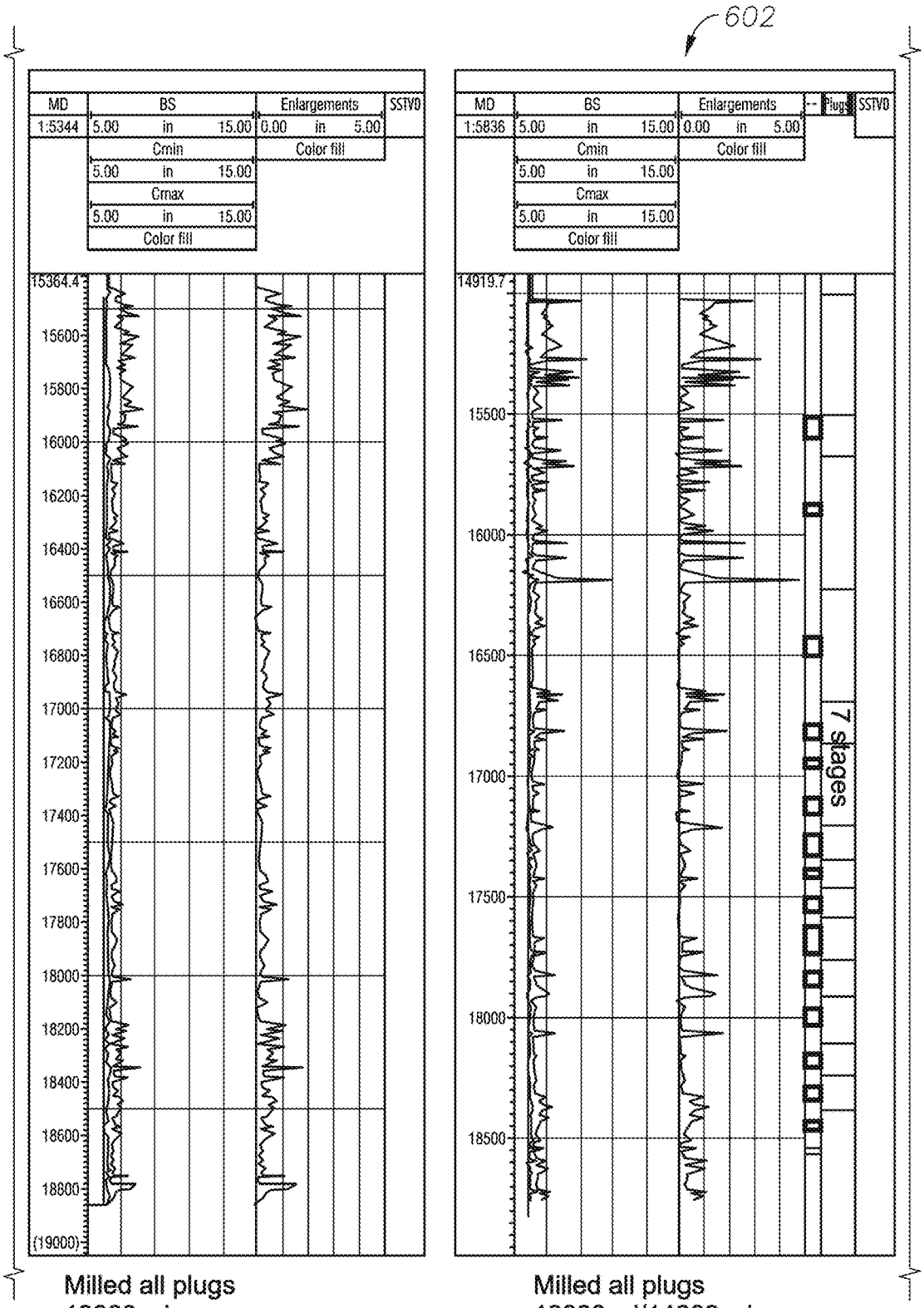
Figure 4C:
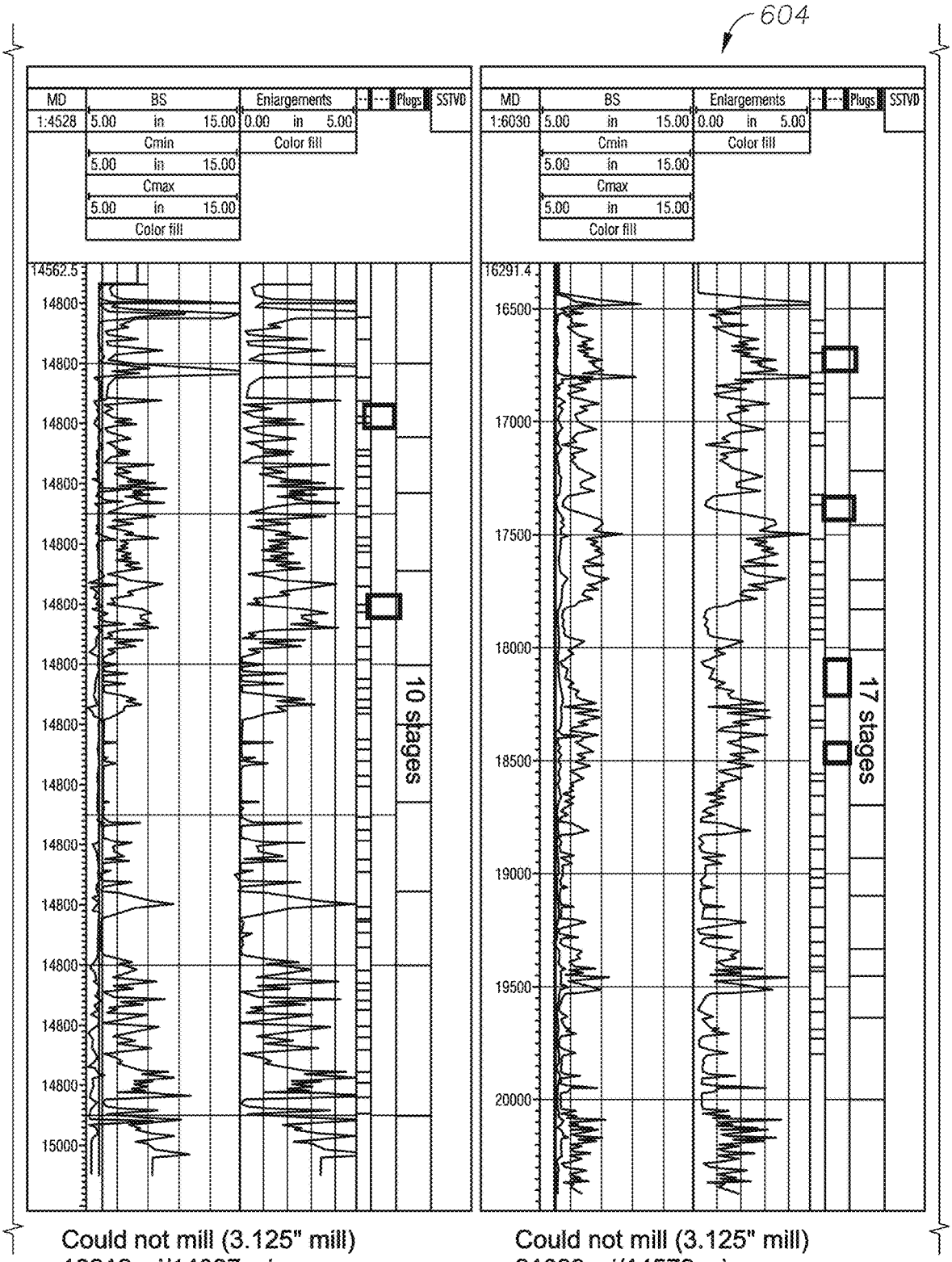
Figure 4D:
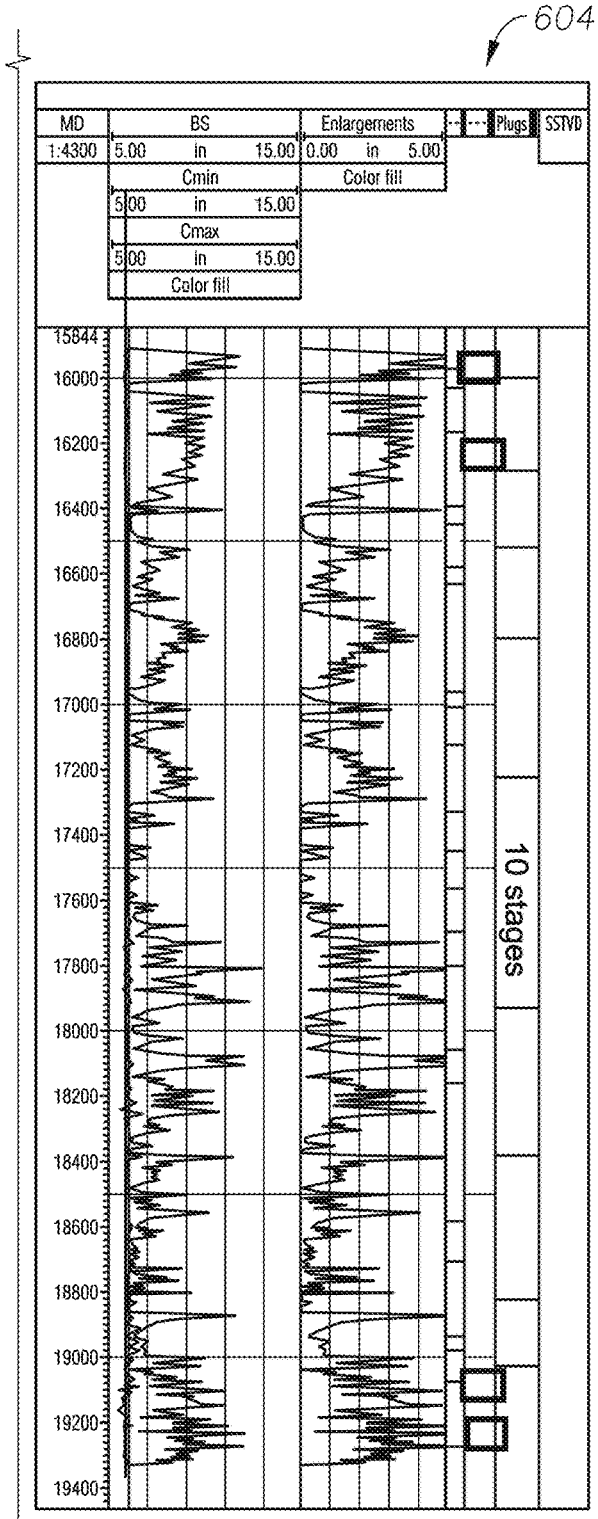

FIG. 3 illustrates various recommendations 31-39 for avoiding pipe deformation, presented in a sequential manner. These additional steps taken before getting to Step 1 of FIG. 2 are marked as Steps 31-35 in FIG. 3. This is followed by additional evaluations in Steps 36 and 37 prior to performing the perf and plug operation in Steps 38 and 39. For example, in Step 31, controlled drilling for an enhanced wellbore is performed. In Step 32, the quality of the hole is determined. In Step 33, petrophysical evaluation of pay zones and hole quality is performed. In Step 34, optimum liner cementing is ensured, and at Step 35, the cemented liner is completed. In Step 36, cement bond log evaluation is performed. In Step 37, the risk-based expert log for perf and plug operation is utilized and a cluster selection is made. In Step 38, the perf and plug operation is performed, and at Step 39, the isolation plugs are drilled out, thereby successfully putting the well into production.

Figure 5:
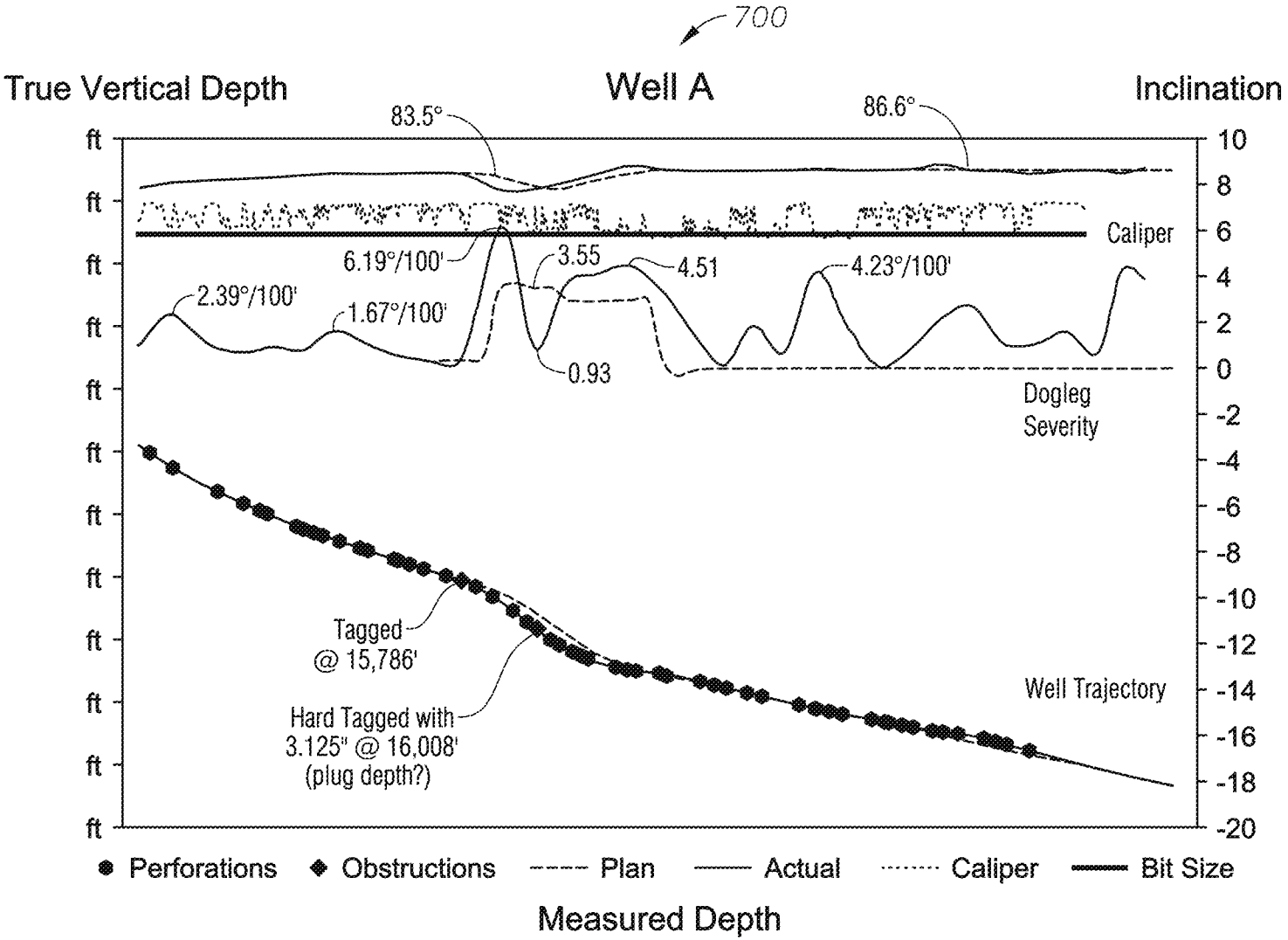
FIG. 5 illustrates example steps in a method for determining risk of pipe deformation in a hydraulic fracturing operation, according to one or more example embodiments of the disclosure.

FIGS. 4A-4D illustrate open hole multi-arm calipers data from multiple wells where no liner deformation 602 has occurred and cases where liner deformation has been reported 604. FIG. 5 illustrates a graph showing true vertical depth on the Y-axis and measured depth on the X-axis. The graph includes plots for inclination, caliper, dogleg severity, and well trajectory for an example well. The type of information shown in FIGS. 4 and 5 were collected on most of the affected wells and non-affected wells to date, and the reasons for the liner deformation phenomenon were thus documented.

Figure 6:
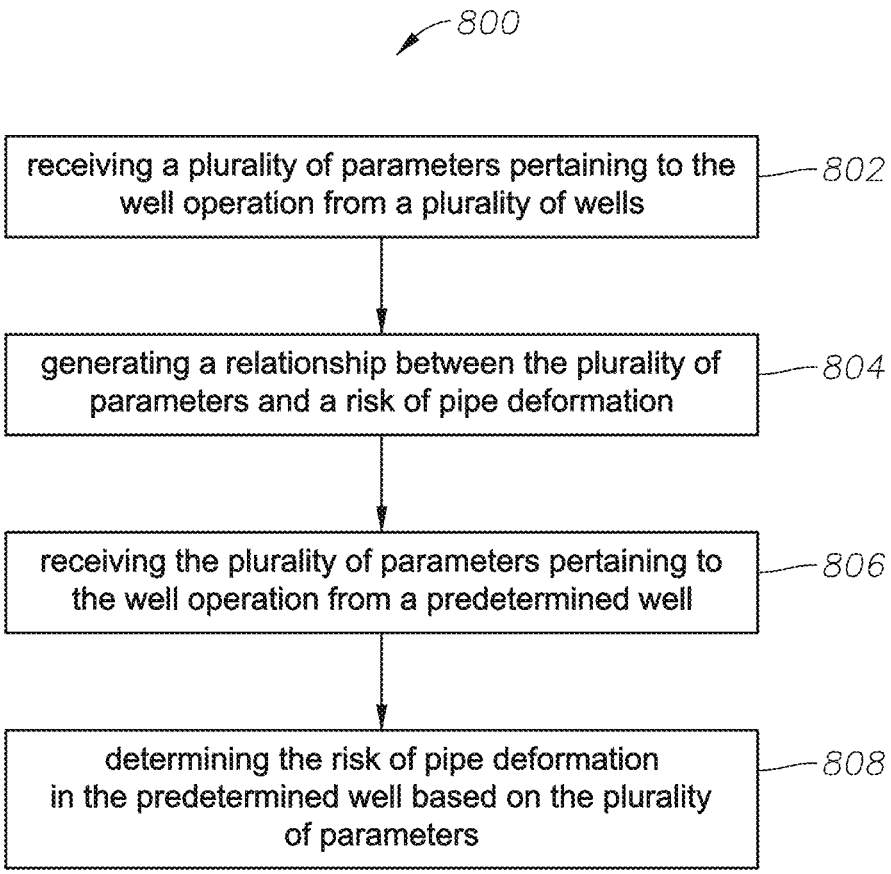
FIG. 6 illustrates example steps in a method for determining risk of pipe deformation in a hydraulic fracturing operation, according to one example embodiment of the disclosure.

FIG. 6 illustrates example steps in a method 800 for determining risk of pipe deformation in a hydraulic fracturing operation, according to one example embodiment of the disclosure. The method includes, at step 802, receiving a plurality of parameters pertaining to the well operation from a plurality of wells where FIGS. 4 and 5 are examples of these plurality of data that was accessed. At step 804, the method includes developing a relationship between the plurality of parameters and a risk of pipe deformation. At step 806, the method includes receiving the plurality of parameters pertaining to the well operation from a predetermined well. At step 808, the method includes determining the risk of pipe deformation in the predetermined well based on the plurality of parameters. The method can further include taking corrective action to prevent the pipe from deformation, such as improving the cementing conditions of the casing, performing cement bond evaluation, choosing safe locations for hydraulic fracturing or skipping zones of high risk or managing around pipe deformation by deploying flow-through bridge plugs, or dissolvable bridge plugs, or any other type of isolation method that does not require well intervention to remove the barrier or altogether re-drill a new, replacement well. The plurality of parameters include at least two of borehole condition, primarily hole size, well deviation, dogleg severity, pipe centralization, cement bond log, presence of natural fractures, and type of hydraulic treatment performed. In one embodiment, the plurality of parameters are weighted in an internal risk matrix.

Figure 7:
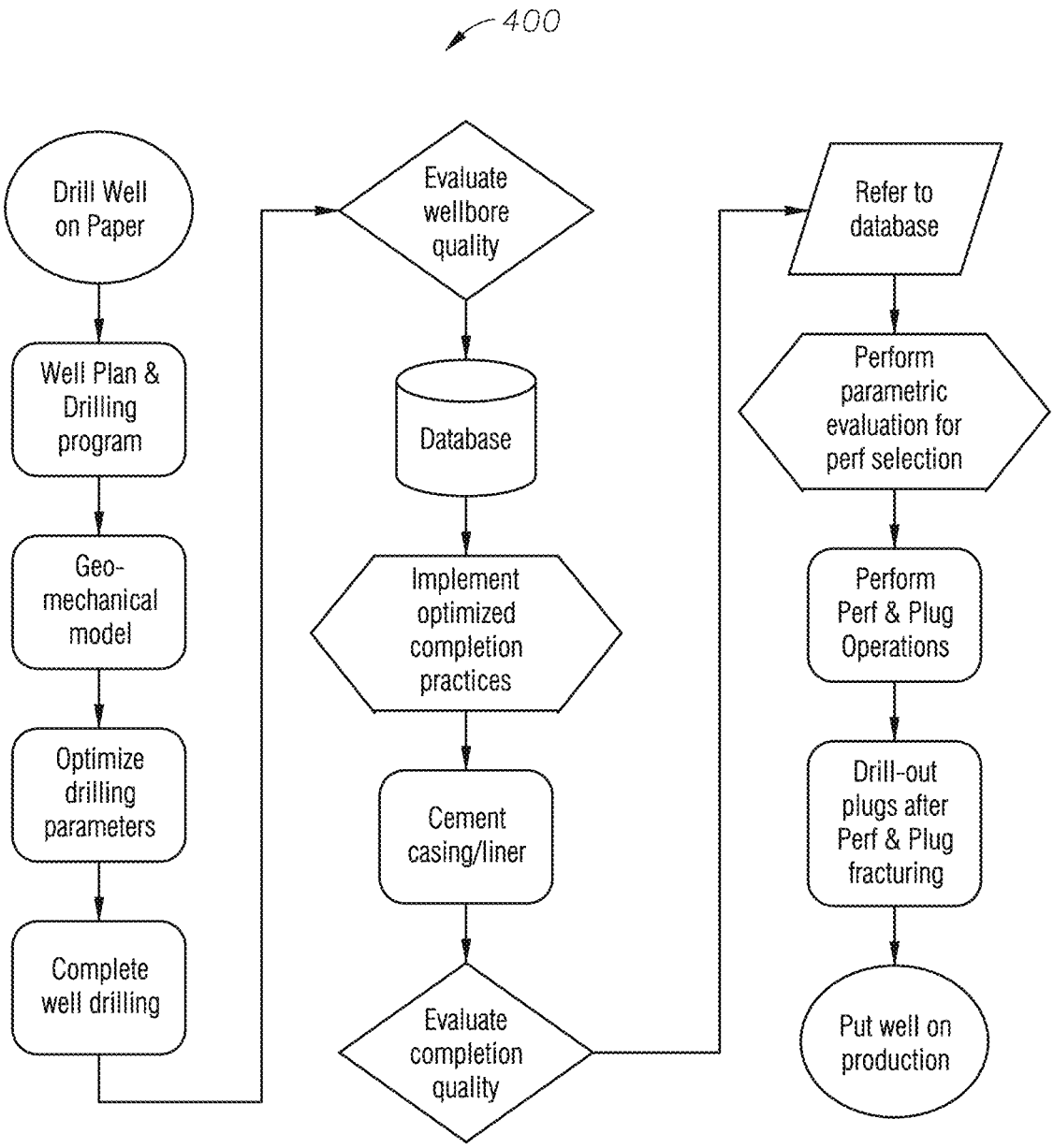
FIG. 7 illustrates example steps in a method for determining risk of pipe deformation in a hydraulic fracturing operation, according to one or more example embodiments of the disclosure.

A comprehensive flowchart of the instant method 400 is presented in FIG. 7. The process of drilling the wellbore is better managed by following a pre-drill geo-mechanical model, optimizing on drilling parameters, and evaluating the wellbore before the completion is run. Wellbore quality is evaluated to make appropriate recommendations at this stage for an effective completion. The geo-mechanical model would assess the wellbore stability while drilling and also establish safe drawdown pressure limits during production in preventing sand movement.

In the case of cemented liner an additional critical step of evaluating the cement bond is essential to determine the likelihood of pipe deformation based on the criteria developed under the assumption that proper cementing practices were followed and the ability of the cement sheath to standup to cyclic pressure loads put during fracturing operations. The zones to be stimulated are identified at this stage in conjunction with the measures needed to be taken to avoid pipe deformation. The perf and plug fracturing process is thereafter followed on the zones identified.

Figure 8A:
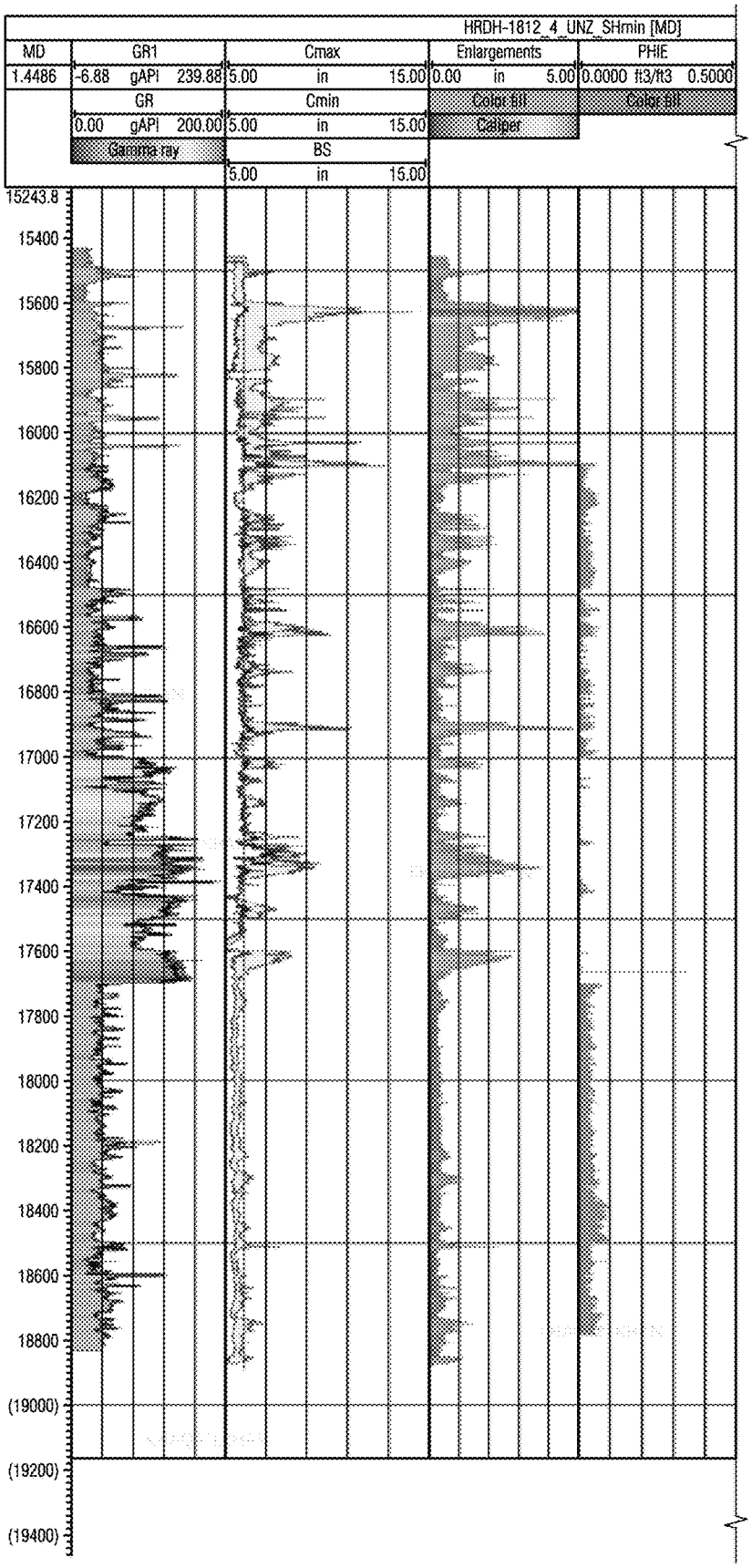
FIGS. 8A-8B illustrate an expert log in a method for determining risk of pipe deformation in a hydraulic fracturing operation, according to one or more example embodiments of the disclosure.
Figure 8B:
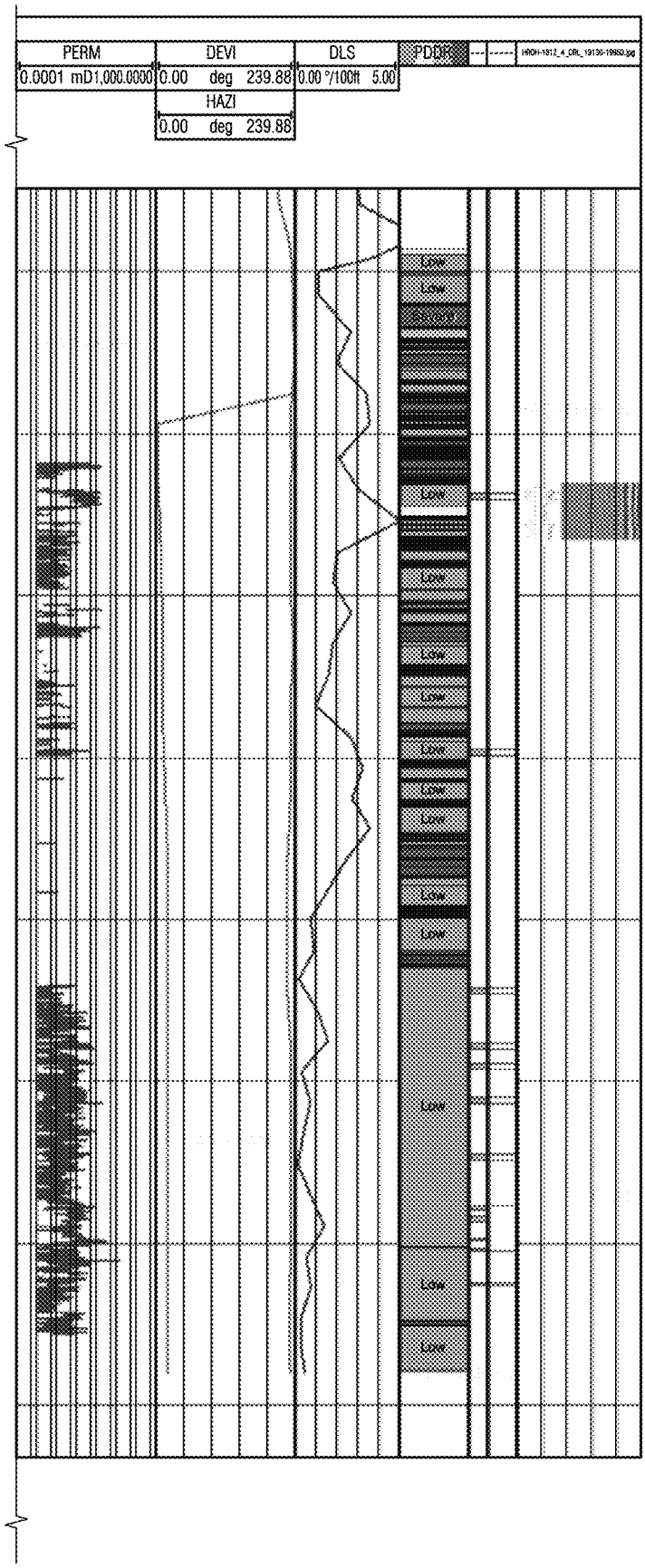

The criteria developed for such determinations is then built in the form of an "expert log". An example of an expert log 500 is shown in FIGS. 8A-8B for illustratively purposes only. As illustrated, the expert log is an expert system that processes key parameters such as the borehole condition (primarily hole size), well deviation, dogleg severity, pipe centralization, cement bond log, presence of natural fractures, the type of hydraulic treatment to be performed (i.e. proppant fracking or acid fracking), and the risk of pipe deformation, in one comprehensive plot. The parameters are weighted in an internal risk matrix and the results (marked as safe or unsafe zones) are displayed in the second from last track on the right of the plot. By being able to predict and avoid pipe deformation on a well could save fracturing costs across high risk areas, maintain well integrity and safety of operations, and not jeopardize production from multi-million dollar well completions. Workflow 500 is been based on actual field data analysis to provide a mechanism for screening and alerting conditions for possible pipe deformation during hydraulic fracturing.

Computer System and Computer Readable Medium

Figure 9:
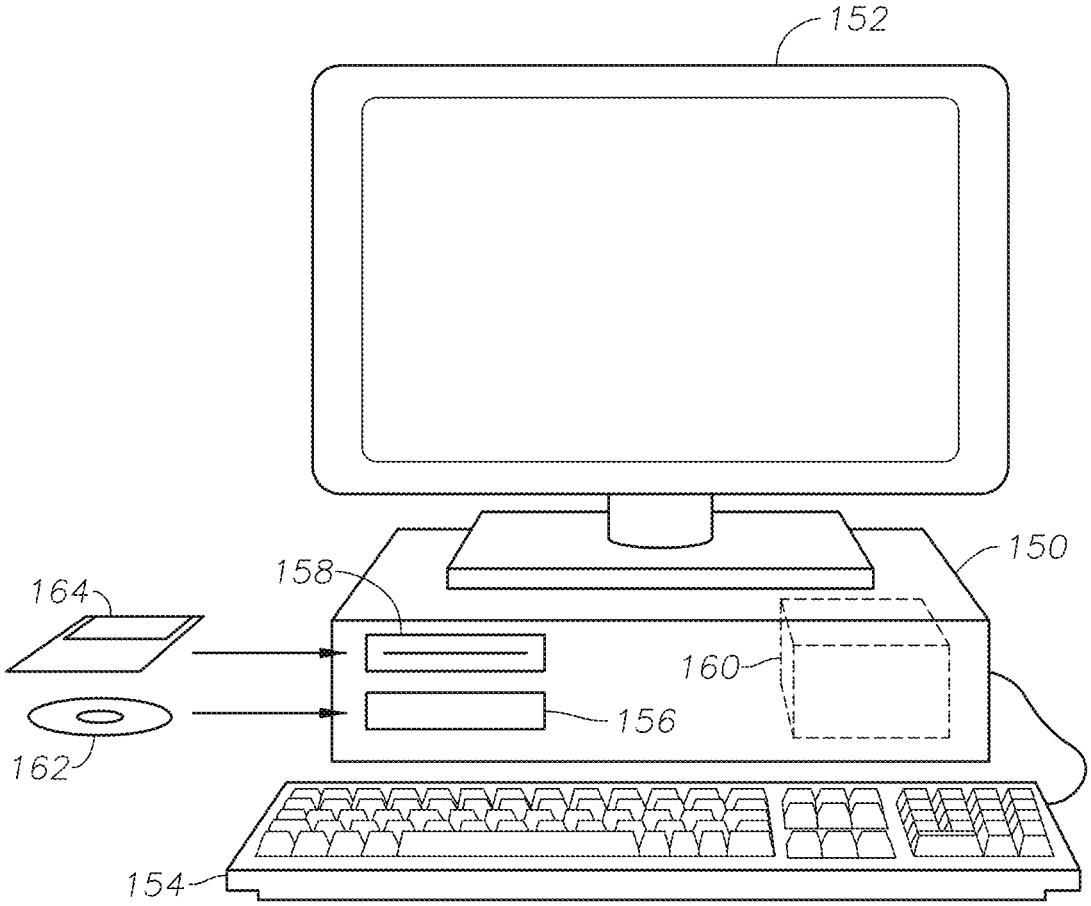
FIG. 9 is an example computer set up for determining risk of pipe deformation in a hydraulic fracturing operation, according to some example embodiments of the disclosure.

FIG. 9 is an example computer set up for determining risk of pipe deformation in a hydraulic fracturing operation, according to some example embodiments of the disclosure. Another example embodiment relates to computer programs stored in computer readable media. Referring to FIG. 9, the foregoing process as explained with reference to FIGS. 1-8 can be embodied in computer-readable code. The code can be stored on, e.g., a non-transitory computer readable medium, such as a floppy disk 164 (or other forms of removable data storage devices such as USB drive), CD-ROM 162, which may be read by disk drives 156, 158, or a magnetic (or other type) hard drive 160 forming part of a general purpose programmable computer. The computer, as known in the art, includes a central processing unit 150, a user input device such as a keyboard 154, and a user display 152 such as a flat panel LCD display or cathode ray tube display. According to this embodiment, the computer readable medium 160, 162, 164 includes logic operable to trigger the computer to execute acts as set forth above and explained with respect to the previous figures. The non-transitory computer-readable medium 160, 162, 164 may have, for example, computer executable instructions that trigger the computer to perform the operations of receiving a plurality of parameters pertaining to the well operation from a plurality of wells, developing a relationship between the plurality of parameters and a risk of pipe deformation, receiving the plurality of parameters pertaining to the well operation from a predetermined well, and determining the risk of pipe deformation in the predetermined well based on the plurality of parameters. The method can further include taking corrective action to prevent the pipe from deformation, such as improving the cementing conditions of the casing, performing cement bond evaluation, choosing safe locations for hydraulic fracturing or skipping zones of high risk or managing around pipe deformation by deploying flow-through bridge plugs, or dissolvable bridge plugs, or any other type of isolation method that does not require well intervention to remove the barrier or altogether re-drill a new, replacement well. The plurality of parameters include at least two of borehole condition, primarily hole size, well deviation, dogleg severity, pipe centralization, cement bond log, presence of natural fractures, and type of hydraulic treatment performed. In one embodiment, the parameters may be weighted in an internal risk matrix.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "operatively connecting" and its conjugated forms means to complete any type of required junction, including electrical, mechanical or fluid, to form a connection between two or more previously non-joined objects. If a first component is operatively connected to a second component, the connection can occur either directly or through a common connector. "Optionally" and its various forms means that the subsequently described event or circumstance may or may not occur. The description includes instances where the event or circumstance occurs and instances where it does not occur.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The systems and methods described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications may readily suggest themselves to those skilled in the art, and are intended to be encompassed within the spirit of the system and method disclosed herein and the scope of the appended claims.

The invention claimed is:

1. A system for determining risk of pipe deformation in a well operation, the system comprising: one or more processors operatively coupled to a non-transitory computer medium comprising computer readable instructions that when executed by the one or more processors cause the one or more processors to perform the operations comprising:

receiving a plurality of parameters pertaining to the well operation from a plurality of wells, wherein the plurality of parameters comprise borehole condition, primarily hole size, well deviation, dogleg severity, pipe centralization, cement bond log, presence of natural fractures, and type of hydraulic treatment performed;

generating a relationship between the plurality of parameters and a risk of pipe deformation, wherein the plurality of parameters are weighted in an internal risk matrix;

receiving the plurality of parameters pertaining to the well operation from a predetermined well; and determining the risk of pipe deformation in the predetermined well based | on the plurality of parameters of the predetermined well; and taking corrective action to prevent the pipe from deformation, wherein the corrective action comprises one or more of: improving cementing conditions of a casing, performing cement bond evaluation, choosing safe locations for hydraulic fracturing, skipping zones of high risk, or altogether re-dill a new, replacement will.

2. The system of claim 1, wherein a type of hydraulic treatment comprises at least one of proppant fracking and acid fracking.

3. The system of claim 1, wherein the well operation comprises a perf and plug hydraulic fracturing operation in a horizontal well.

4. A method for determining risk of pipe deformation in a well | operation, the method comprising:

receiving, by a processor, a plurality of parameters pertaining to the well operation from a plurality of wells, wherein the plurality of parameters comprise borehole condition, primarily hole size, well deviation, dogleg severity, pipe centralization, cement bond log, presence of natural fractures, and type of hydraulic treatment performed;

generating a relationship between the plurality of parameters and a risk of pipe | deformation, wherein the plurality of parameters are weighted in an internal risk matrix;

receiving the plurality of parameters pertaining to the well operation from a predetermined well; and determining the risk of pipe deformation in the predetermined well based | on the | plurality of parameters of the predetermined well; and taking corrective action to prevent the pipe from the -cementing conditions of the-a casing, performing cement bond evaluation, choosing safe locations for hydraulic fracturing, skipping zones of high risk, or altogether re-drill a new, replacement well.

5. The method of claim 4, wherein a type of hydraulic treatment comprises at least one of proppant fracking and acid fracking.

6. The method of claim 4, wherein the well operation comprises a perf and plug hydraulic fracturing operation in a horizontal well.

7. A non-transitory computer medium comprising computer readable instructions that when executed by a processor cause the processor to perform operations comprising:

receiving a plurality of parameters pertaining to a well operation from a plurality of wells, wherein the plurality of parameters comprise borehole condition, primarily hole size, well deviation, dogleg severity, pipe centralization, cement bond log, presence of natural fractures, and type of hydraulic treatment performed;

generating a relationship between the plurality of parameters and a risk of pipe deformation, wherein the plurality of parameters are weighted in an internal risk matrix;

receiving the plurality of parameters pertaining to the well operation from a predetermined well; and determining the risk of pipe deformation in the predetermined well based on the plurality of parameters of the predetermined well; and taking corrective action to prevent the pipe from deformation, wherein the corrective action comprises one or more of: improving cementing conditions of a casing, performing cement bond evaluation, choosing safe locations for hydraulic fracturing, skipping zones of high risk, or altogether re-drill a new, replacement well.

* * * * *